US009564255B2

(12) United States Patent
Sagawa et al.

(10) Patent No.: US 9,564,255 B2
(45) Date of Patent: Feb. 7, 2017

(54) HIGH-SPEED TRANSMISSION CABLE CONDUCTOR, AND PRODUCING METHOD THEREOF, AND HIGH-SPEED TRANSMISSION CABLE

(71) Applicant: HITACHI METALS, LTD., Tokyo (JP)

(72) Inventors: Hideyuki Sagawa, Tokai-mura (JP); Seigi Aoyama, Kitaibaraki (JP); Toru Sumi, Hitachi (JP); Keisuke Fujito, Mito (JP); Detian Huang, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/091,674

(22) Filed: Nov. 27, 2013

(65) Prior Publication Data

US 2014/0209349 A1 Jul. 31, 2014

(30) Foreign Application Priority Data

Jan. 30, 2013 (JP) ..... 2013-015430

(51) Int. Cl.
*H01B 11/18* (2006.01)
*H01B 13/016* (2006.01)
*H01B 1/02* (2006.01)

(52) U.S. Cl.
CPC ..... *H01B 1/026* (2013.01)

(58) Field of Classification Search
None
See application file for complete search history.

(56) References Cited

U.S. PATENT DOCUMENTS

| | | | | |
|---|---|---|---|---|
| 3,729,294 | A * | 4/1973 | Hibbs | 428/626 |
| 4,376,154 | A | 3/1983 | Nakatsugawa | |
| 5,709,958 | A | 1/1998 | Toyoda et al. | |
| 8,637,163 | B2 | 1/2014 | Tokuda et al. | |
| 8,663,818 | B2 | 3/2014 | Nose et al. | |
| 2005/0127364 | A1* | 6/2005 | Inoue | 257/72 |
| 2009/0053555 | A1 | 2/2009 | Nose et al. | |
| 2010/0263905 | A1 | 10/2010 | Aoyama et al. | |
| 2010/0270063 | A1 | 10/2010 | Suzuki et al. | |
| 2011/0123729 | A1* | 5/2011 | Lee | G02F 1/133512 428/1.6 |
| 2012/0318361 | A1* | 12/2012 | Teeter | H01L 31/0326 136/264 |
| 2013/0048598 | A1 | 2/2013 | Ushioda et al. | |

(Continued)

FOREIGN PATENT DOCUMENTS

| | | | |
|---|---|---|---|
| CN | 1322857 | A | 11/2001 |
| JP | 62-040361 | A | 2/1987 |

(Continued)

OTHER PUBLICATIONS

Shoji et al, JP62-04036_HT. Feb. 21, 1987.*
Park et al., A Study on Corrosion Characterization of Plasma Oxidized 65/35 Brass with Various Frequencies, Surface & Coatings Technology, 200, 2005. pp. 77-82.
Japanese Office Action, Dec. 2, 2014.
USPTO Office Action, U.S. Appl. No. 13/904,950, Nov. 19, 2015, 14 pages.

(Continued)

*Primary Examiner* — Vera Katz
(74) *Attorney, Agent, or Firm* — Foley & Lardner LLP

(57) ABSTRACT

A high-speed transmission cable conductor includes a core material includes mainly copper, and a surface treated layer formed around a surface of the core material. The surface treated layer includes an amorphous layer including a metal element having a higher affinity for oxygen than the copper, and oxygen.

5 Claims, 5 Drawing Sheets

(56) References Cited

U.S. PATENT DOCUMENTS

| | | | | |
|---|---|---|---|---|
| 2013/0323532 | A1* | 12/2013 | Sagawa et al. | 428/659 |
| 2014/0209349 | A1 | 7/2014 | Sagawa et al. | |
| 2015/0152567 | A1 | 6/2015 | Sagawa et al. | |

FOREIGN PATENT DOCUMENTS

| | | | |
|---|---|---|---|
| JP | 1-205065 | A | 8/1989 |
| JP | 2001-059198 | A | 3/2001 |
| JP | 2004-176082 | A | 6/2004 |
| JP | 2006-307277 | A | 11/2006 |
| JP | 2007-208263 | A | 8/2007 |
| JP | 2008-045203 | A | 2/2008 |
| JP | 2008-293894 | A | 12/2008 |
| JP | 2010-163641 | A | 7/2010 |
| WO | WO 2007/108496 | A1 | 9/2009 |

OTHER PUBLICATIONS

USPTO Office Action, U.S. Appl. No. 13/904,950, Apr. 22, 2016, 19 pages.

USPTO Office Action, U.S. Appl. No. 14/497,709, Apr. 25, 2016, 20 pages.

USPTO Office Action, U.S. Appl. No. 14/514,819, Apr. 11, 2016, 19 pages.

Chinese Office Action, Application No. 201310193506.4, Apr. 25, 2016, 11 pages.

Chinese Office Action, Application No. 201310627921.6, Jun. 21, 2016, 11 pages.

USPTO Office Action, U.S. Appl. No. 14/514,819, Aug. 30, 2016, 13 pages.

USPTO Office Action, U.S. Appl. No. 14/497,709, Sep. 21, 2016, 9 pages.

* cited by examiner

HIGH-SPEED TRANSMISSION CABLE CONDUCTOR, AND PRODUCING METHOD THEREOF, AND HIGH-SPEED TRANSMISSION CABLE

The present application is based on Japanese patent application No. 2013-015430 filed on Jan. 30, 2013, the entire contents of which are incorporated herein by reference.

BACKGROUND OF THE INVENTION

1. Field of the Invention

This invention relates to a high-speed transmission cable conductor using a core material made of copper or a copper alloy, and a producing method therefor, and a high-speed transmission cable.

2. Description of the Related Art

Electronic devices such as servers, routers, storages, etc. handle high-speed digital signals with a transmission speed of several Gbps or higher. The electronic devices of this kind require interfaces for lessening signal waveform degradation and having excellent high-frequency transmission properties, in signal transmissions between devices, between chassis in devices, between substrates in devices, and the like. One of the interfaces is a high-speed transmission cable.

This high-speed transmission cable generally uses a coaxial cable. The coaxial cable comprises a core wire (also called inner conductor or center conductor), an insulator which covers a circumference of the core wire, an outer conductor which covers a circumference of the insulator, and a jacket (also called sheath) which covers a circumference of the outer conductor.

The core wire is connected with a signal line of the electronic devices, while the outer conductor is connected with ground of the electronic devices, so that a signal is transmitted in the core wire. In the case where a plated wire, in which a material having high resistance is arranged as its surface layer, is used in the coaxial cable, when the frequency of the signal to be transmitted is high (i.e., the transmission rate is high), transmission loss is significant due to a skin effect caused in the core wire. This tendency manifests more prominently in accordance with the increase in cable length. As a result, long-distance signal transmission causes the rounding of the originally rectangular digital signal waveform. The transmitted signal degrades and cannot properly be transmitted.

In the case where a tin-plated copper wire to be used in a general cable is used in the high-speed transmission cable, due to the Sn having a significantly low electrical conductivity of 15% IACS plated as the conductor surface layer around the annealed copper having an electrical conductivity of 100% IACS, the skin effect increases the attenuation of the transmitted signal caused by the resistance of the conductor in a high frequency region.

Therefore, a conductor formed with Ag plating having high electrical conductivity around its surface has been selected as the conductor for the high-speed transmission cable for use in a high frequency region (see, e.g. JP-A-2006-307277 and JP-A-2008-293894).

In the high-speed transmission cable conductor disclosed in JP-A-2006-307277, in order to reduce the occurrence of wire breaking, a wire rod made of copper or a copper alloy has been formed with a Ag plating layer therearound which is harder than that wire rod. In the high-speed transmission cable conductor disclosed in JP-A-2008-293894, in order to increase its bending resistance than a bending resistance of pure copper, a coating layer comprising Ag or Ag alloy has been formed around a circumference of a core material made of pure copper or a copper alloy.

SUMMARY OF THE INVENTION

The conventional high-speed transmission cable conductor formed with the coating layer made of Ag around the surface of the core material made of copper or a copper alloy has been small in the attenuation of the transmitted signal. However, since the cost of Ag material is high, it will inevitably become a costly product.

When a bare copper conductor having excellent electrical conductivity similarly to the Ag plated conductor is applied to the high-speed transmission cable, there will be no problem with high frequency transmission properties, but due to heat in cable production and due to temperature and humidity in material storage, an oxide film around the copper conductor surface may be grown, soldering may fail and a problem with connection reliability may occur.

On the other hand, the conventional transmission cable conductor formed with the coating layer made of Sn around the surface of the core material made of copper or a copper alloy may increase the attenuation of the transmitted signal when applied to high-frequency transmission applications.

Accordingly, it is an object of the present invention to provide a high speed transmission cable conductor, which is lower in cost than that formed with a coating layer made of Ag around a surface of a core material, but which is excellent in connection reliability and high frequency transmission properties.

It is another object of the present invention to provide a producing method for the high-speed transmission cable conductor.

It is still another object of the present invention to provide a high-speed transmission cable.

In order to achieve the above objects, in one aspect of the invention, a high-speed transmission cable conductor, and a producing method therefor and a high-speed transmission cable are provided below.

(1) According to a first embodiment of the invention, a high-speed transmission cable conductor comprises:

a core material comprising mainly copper; and a surface treated layer formed around a surface of the core material, the surface treated layer comprising an amorphous layer including a metal element having a higher affinity for oxygen than the copper, and oxygen.

In the first embodiment, the following modifications and changes can be made.

(i) The amorphous layer further includes copper diffused from the core material.

(ii) The surface treated layer further comprises a diffusion layer under the amorphous layer, the diffusion layer including copper and a metal element having a higher affinity for oxygen than the copper, or copper, a metal element having a higher affinity for oxygen than the copper, and oxygen.

(iii) The metal element having a higher affinity for oxygen than the copper in the amorphous layer is zinc.

(iv) The surface treated layer comprises a thickness of not less than 3 nm and not more than 0.6 μm.

(v) A total thickness of the amorphous layer and the diffusion layer comprises not less than 6 nm and not more than 0.6 μm (2) According to a second embodiment of the invention, a high-speed transmission cable conductor producing method comprises:

forming a coating layer comprising a metal element having a higher affinity for oxygen than copper around a surface of a core material comprising mainly copper; and heat treating the coating layer at a temperature of not less than 50 degrees Celsius and not more than 150 degrees Celsius, and for a time period of not less than 30 seconds and not more than 60 minutes, to thereby form a surface treated layer.

In the second embodiment, the following modifications and changes can be made.

(i) The metal element having a higher affinity for oxygen than the copper is zinc.

(ii) The surface treated layer comprises a thickness of not less than 3 nm and not more than 0.6 μm.

(3) According to a third embodiment of the invention, a high-speed transmission cable uses the high-speed transmission cable conductor according to (1) as an inner conductor.

(Points of the Invention)

According to the invention, it is possible to provide the high speed transmission cable conductor, which is lower in cost than that formed with a coating layer made of Ag around a surface of a core material, but which is excellent in connection reliability and high frequency transmission properties. It is also possible to provide the producing method for the high-speed transmission cable conductor. It is further possible to provide the high-speed transmission cable.

BRIEF DESCRIPTION OF THE DRAWINGS

The preferred embodiments according to the invention will be explained below referring to the drawings, wherein.

DETAILED DESCRIPTION OF THE EMBODIMENTS

Next, embodiments and Examples according to the invention will be explained in conjunction with the accompanying drawings. Incidentally, in these figures, elements including substantially the same functions are given the same numerals, and duplicate descriptions thereof are omitted.

SUMMARY OF THE EMBODIMENTS

A high-speed transmission cable conductor in the present embodiment includes a core material comprising mainly copper, and a surface treated layer formed around a surface of the core material, the surface treated layer comprising an amorphous layer including a metal element having a higher affinity for oxygen than the copper, and oxygen.

Because in the surface treated layer, different elements are in contact at an interface, the surface treated layer typically presents a gradual concentration change at the interface between the different elements, and makes the definition of thickness of the surface treated layer difficult. Therefore, herein, the thickness of the surface treated layer is defined as "the thickness of the layer including a metal element having a higher affinity for oxygen than copper, and oxygen, and if desired, copper, and the thickness of the layer including not less than 2 at % of any of the elements constituting that layer in element content (atomic concentration (at %)) ratio".

First Embodiment

Figure 1:
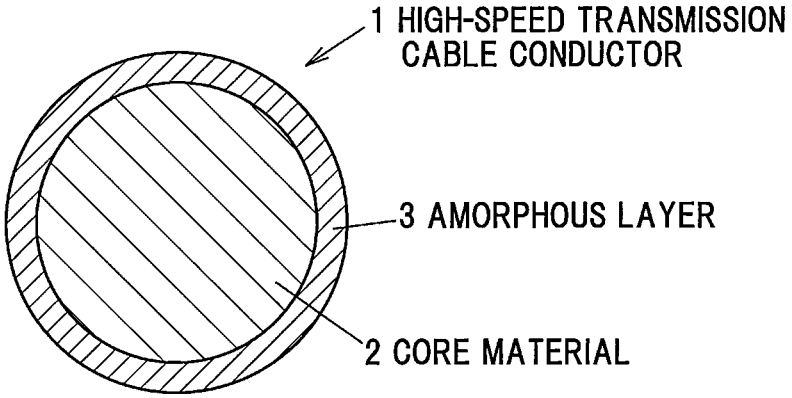
FIG. 1 is a cross sectional view schematically showing a high-speed transmission cable conductor in a first embodiment according to the invention.

FIG. 1 is a cross sectional view schematically showing a high-speed transmission cable conductor in a first embodiment according to the invention. The high-speed transmission cable conductor 1 in the present embodiment comprises a core material 2 having a circular cross section comprising mainly copper, and an amorphous layer 3 formed around a surface of the core material 2. The amorphous layer 3 is one example of the surface treated layer.

As a material comprising mainly copper which constitutes the core material 2, e.g., pure oxygen-free copper, tough pitch copper, or a copper alloy may be used. As the copper alloy, e.g., a dilute copper alloy including 3 to 15 ppm by mass of sulfur, 2 to 30 ppm by mass of oxygen, and 5 to 55 ppm by mass of Ti may be used.

The amorphous layer 3 includes, e.g., a metal element having a higher affinity for oxygen than copper and oxygen, or a metal element having a higher affinity for oxygen than copper, oxygen, and copper diffused from the core material 2.

As the metal element having a higher affinity for oxygen than copper which constitutes the amorphous layer 3, Zn is preferred. Besides Zn, e.g., Ti, Mg, Zr, Al, Fe, Sn, Mn and the like may be listed. From the viewpoint of recycling, among others, Ti, Mg and Zr which tend to be oxidized and removed during production of the copper are preferable.

Because the amorphous layer 3 in which the elements are arranged at random is considered to have a dense structure as compared with a crystalline layer in which elements are regularly arranged, the amorphous layer 3 suppresses or reduces the diffusion of copper to the surface of the surface treated layer which causes the oxidation of the copper material, and the penetration of oxygen into the copper material. As a result, it is considered that the amorphous layer 3 acts as a barrier layer that prevents the bonding of the copper and the oxygen.

The thickness of the surface treated layer consisting of the amorphous layer 3 in the present embodiment is preferably not less than 3 nm and not more than 0.6 μm, more preferably not less than 6 nm and not more than 0.6 μm, though depending on the heat treatment conditions.

In order to form the amorphous layer 3, it is necessary to predominantly bond the oxygen and the metal element other than the copper, and in order to accelerate the formation of the amorphous layer 3, it is preferable to arrange the metal element (e.g., Zn) having a higher affinity for oxygen than the copper of the core material 2 around the surface of the core material 2.

Production Method for the First Embodiment

Next, one example of a producing method of the high-speed transmission cable conductor 1 in the first embodiment will be explained.

First, the core material 2 comprising mainly copper is prepared.

Next, around the surface of the core material 2, a coating layer comprising the metal element having a higher affinity for oxygen than the copper, such as a Zn layer, is formed. The formation of the Zn layer may use, e.g. plating, sputtering, vacuum metallization, cladding, or the like. Of these methods, the plating (electroplating) is preferable from the point of view of being low in film formation process cost. Incidentally, the thickness of the Zn layer is preferably not more than 0.6 μm in a final product.

Next, heat treatment is performed in the atmosphere in conditions of a temperature of not less than 50 degrees Celsius and not more than 150 degrees Celsius, and a time period of not less than 30 seconds and not more than 60 minutes. The heat treatment is not limited to that incorporated intentionally in the conductor producing process, but if the above conditions are concomitantly given, e.g., in conductor transport, or in the process for extrusion coating of the insulating material around the conductor, it is possible to achieve the same advantageous effects. The high-speed transmission cable conductor 1 is produced in the manner described above.

Incidentally, another production method may be as follows: Before processing into a final product size and shape, Zn is pre-plated (preferably not more than 20 μm, more preferably not more than 15 μm), followed by processing into a final product size and shape, and forming the not more than 0.6 μm coating layer.

Advantageous Effects of the First Embodiment

The present embodiment has the following advantageous effects.

(A) It is possible to form the amorphous layer including Zn and oxygen by the simple method only coating the Zn around the surface of the core material comprising mainly copper, coating Zn around the surface of the diffusion layer and performing the prescribed heat treatment.

(B) Since the coating layer uses more inexpensive Zn than Ag, it is possible to produce the high-speed transmission cable conductor at a low cost.

(C) Since an oxide film is prevented from growing around the surface of the core material by coating the surface of the core material, it is possible to provide the high-speed transmission cable conductor having excellent connection reliability.

(D) The Zn of the coating layer is as relatively low as approximately 28% IACS in electrical conductivity, but because the thickness of the coating layer to be required by the present technique is sufficiently thin as compared with Sn or the like, it is possible to provide the high-speed transmission cable conductor having excellent high-frequency transmission properties.

(E) The high-speed transmission cable conductor and the high-speed transmission cable according to the invention have the significantly advantageous effects for 5 GHz or higher frequency transmission. The reason therefor is as follows: In use of the conventional Sn plated conductor, in a lower than 5 GHz frequency region, because its skin thickness from its surface layer in which mainly electric current is caused to flow by the skin effect (Hereinafter, referred to as "skin thickness") is relatively thick, the electric current flows in the copper core material as well, and the Sn in the surface layer has little electrical conductivity lowering effect. On the other hand, at 5 GHz or higher frequencies, due to the skin thickness being thin, the electrical conductivity lowering is significant, and the Sn plated conductor cannot be used at 5 GHz or higher frequencies. Since also for the skin thickness in the high frequency region the thickness of the surface treated layer is small, the present invention can reduce the occurrence of transmission property lowering in the 5 GHz or higher frequency transmissions.

(F) In a high frequency transmission cable conductor terminal connection method, ultrasonic connection besides solder connection can be applied. It should be noted, however, that in use of the Sn plated conductor, due to the melting point of the Sn being as low as 232 degrees Celsius, the Sn in the surface layer is molten by frictional heat in ultrasonic connection, making it difficult to achieve sufficient connection strength by ultrasonic connection. On the other hand, with the high-speed transmission cable conductor according to the present invention, since the surface treated layer is the amorphous layer having oxygen and is sufficiently thin in thickness, joining is possible without melting during ultrasonic connection. Therefore, sufficient connection strength can be achieved by ultrasonic connection.

Second Embodiment

Figure 2:
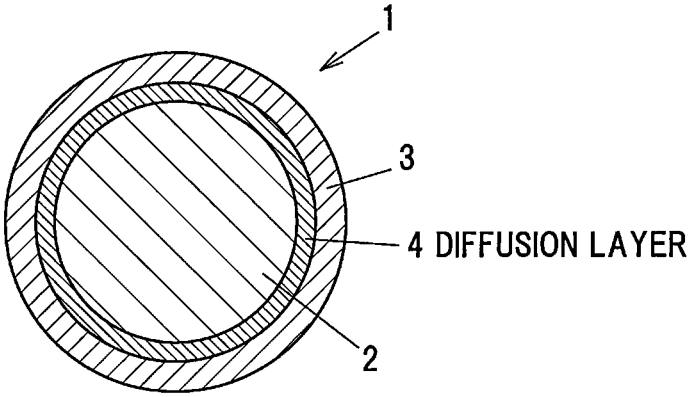
FIG. 2 is a cross sectional view schematically showing a high-speed transmission cable conductor in a second embodiment according to the invention.

FIG. 2 is a cross sectional view schematically showing a high-speed transmission cable conductor in a second embodiment according to the invention. The high-speed transmission cable conductor 1 in the present embodiment is one formed with a diffusion layer 4 which is a crystalline layer under the amorphous layer 3 in the first embodiment. In addition, the amorphous layer 3 and the diffusion layer 4 in the present embodiment constitute a surface treated layer.

The diffusion layer 4 comprises a crystalline layer which may include copper and a metal element having a higher affinity for oxygen than the copper, or copper, a metal element having a higher affinity for oxygen than the copper, and oxygen. Incidentally, the diffusion layer 4 comprising copper, a metal element having a higher affinity for oxygen than the copper, and oxygen is preferred. The diffusion layer 4 is different from the amorphous layer 3 in that the crystal structure of the diffusion layer 4 is crystalline while the crystal structure of the amorphous layer 3 is amorphous.

For the metal element having a higher affinity for oxygen than the copper, which constitutes the diffusion layer 4, it is possible to use a metal element similar to the metal element having a higher affinity for oxygen than the copper, which constitutes the amorphous layer 3, but it is preferable to use the same metal element as that of the amorphous layer 3.

The thickness of the surface treated layer consisting of the amorphous layer 3 and the diffusion layer 4 in the present embodiment is preferably not less than 6 nm and not more than 0.6 μm though depending on the thickness of the diffusion layer 4 and the heat treatment conditions.

The thickness of the diffusion layer 4 is not particularly limited in its lower limit, but may cover the copper core material, and, in practice, the lower limit of the covering thickness of the diffusion layer 4 is preferably about 3 nm. Further, the upper limit of the thickness of the diffusion layer 4 is preferably not more than 0.5 μm. If it is more than 0.5 μm, it is difficult to stably form the amorphous layer 3 which contributes to the manifestation of high corrosion resistance. The thickness of the amorphous layer 3 is not particularly limited, but is preferably not less than 3 nm.

Production Method for the Second Embodiment

Next will be described one example of a producing method of the high-speed transmission cable conductor 1 in the second embodiment.

First, there is prepared the core material 2 comprising mainly copper.

Then, the diffusion layer 4 is formed around the surface of the core material 2. The diffusion layer 4 may be formed by coating Zn around the surface of the core material 2, and heating in the atmosphere at a temperature of not less than 50 degrees Celsius, or holding in an oil bath, a salt bath. In addition, it can also be formed using an electrical resistance heating.

After the formation of the diffusion layer 4, the amorphous layer 3 is formed therearound, in the same manner as in the first embodiment. That is, a coating layer comprising a metal element having a higher affinity for oxygen than copper, such as a Zn layer, is formed around the surface of the diffusion layer 4 by electrolytic plating.

Next, heat treatment is performed in the atmosphere in conditions of a temperature of not less than 50 degrees Celsius and not more than 150 degrees Celsius, and a time period of not less than 30 seconds and not more than 60 minutes. The high-speed transmission cable conductor 1 is produced in the manner described above.

Advantageous Effects of the Second Embodiment

The present embodiment has the following advantageous effects.

(A) It is possible to form the amorphous layer including Zn and oxygen by the simple method only forming the diffusion layer around the surface of the core material comprising mainly copper, coating the Zn around the surface of the diffusion layer and performing the prescribed heat treatment.

(B) As with the first embodiment, it is possible to produce the high-speed transmission cable conductor 1 at a low cost.

(C) As with the first embodiment, it is possible to provide the high-speed transmission cable conductor which is excellent in connection reliability and high-frequency transmission properties.

(E) The high-speed transmission cable conductor and the high-speed transmission cable according to the invention have the significantly advantageous effects for 5 GHz or higher frequency transmission. The reason therefor is as follows: In use of the conventional Sn plated conductor, in a lower than 5 GHz frequency region, because its skin thickness from its surface layer in which mainly electric current is caused to flow by the skin effect (Hereinafter, referred to as "skin thickness") is relatively thick, the electric current flows in the copper core material as well, and the Sn in the surface layer has little electrical conductivity lowering effect. On the other hand, at 5 GHz or higher frequencies, due to the skin thickness being thin, the electrical conductivity lowering is significant, and the Sn plated conductor cannot be used at 5 GHz or higher frequencies. Since also for the skin thickness in the high frequency region the thickness of the surface treated layer is small, the present invention can reduce the occurrence of transmission property lowering in the 5 GHz or higher frequency transmissions.

(F) In a high frequency transmission cable conductor terminal connection method, ultrasonic connection besides solder connection can be applied. It should be noted, however, that in use of the Sn plated conductor, due to the melting point of the Sn being as low as 232 degrees Celsius, the Sn in the surface layer is molten by frictional heat in ultrasonic connection, making it difficult to achieve sufficient connection strength by ultrasonic connection. On the other hand, with the high-speed transmission cable conductor according to the present invention, since the surface treated layer includes the amorphous layer having oxygen and is sufficiently thin in thickness, joining is possible without melting during ultrasonic connection. Therefore, sufficient connection strength can be achieved by ultrasonic connection.

Third Embodiment

Figure 3:
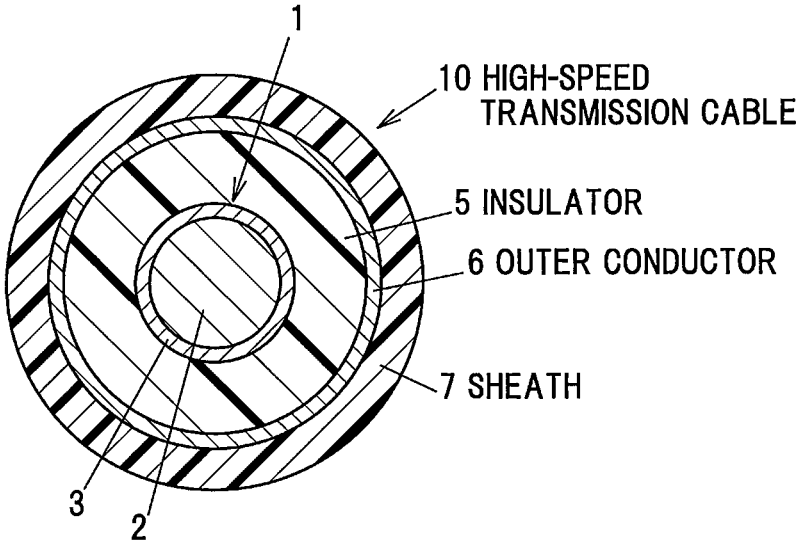
FIG. 3 is a cross sectional view schematically showing a high-speed transmission cable in a third embodiment according to the invention.

FIG. 3 is a cross sectional view schematically showing a high-speed transmission cable in a third embodiment according to the invention. The high speed transmission cable 10 in the present embodiment uses the high speed transmission cable conductor 1 in the first embodiment as the inner conductor, and the surface of the inner conductor is covered with an insulator 5, and the insulator 5 is covered with an outer conductor 6 therearound which has a noise shielding function, and the outer conductor 6 is covered with a sheath 7 therearound.

According to the present embodiment, it is possible to provide the high-speed transmission cable conductor which is low in cost yet excellent in connection reliability and high frequency transmission properties.

It is also possible to use the high-speed transmission cable conductor 1 in the second embodiment instead of the high-speed transmission cable conductor 1. In addition, a stranded wire comprising a plurality of the twisted high-speed transmission cable conductors 1 may be used as the inner conductor.

EXAMPLES

Respective configurations of high-speed transmission cable conductors in Examples 1 to 8, which correspond to the first embodiment according to the invention, Comparative examples 1 to 3, and Conventional examples 1 to 3 are shown in Table 1. In addition, respective rated results of rated items, which will be described later, are also shown in Table 1. In Table 1, for rating high-frequency transmission properties, when at a frequency of 10 GHz the resistance attenuation in Conventional example 3 was set as a benchmark, if the resistance increase was less than 10%, the high-frequency transmission properties are rated as "Good," or if the resistance increase was not less than 10% and less than 20%, the high-frequency transmission properties are rated as "Insufficient," or if the resistance increase was not less than 20%, the high-frequency transmission properties are rated as "Poor." In addition, for rating cost, when the cost of Ag was set as poor, if the cost was not more than 70% of the cost of Ag, it was rated as "Good." For overall rating, the connection failure rate, high-frequency transmission properties, and cost items are overall rated as "Good," "Insufficient," or "Poor."

TABLE 1

Table 1

| | | Core material | Surface-treated layer: Material | Surface-treated layer: Thickness (μm) | Surface-treated layer: Presence/Absence of amorphous layer | Rated results: Connection failure rate (%) | Rated results: Transmission properties | Rated results: Cost | Rated results: Overall rating |
|---|---|---|---|---|---|---|---|---|---|
| Example | 1 | Cu | Zn | 0.003 | Present | 0 | Good | Good | Good |
| | 2 | Cu | Zn | 0.006 | Present | 0 | Good | Good | Good |
| | 3 | Cu | Zn | 0.01 | Present | 0 | Good | Good | Good |
| | 4 | Cu | Zn | 0.02 | Present | 0 | Good | Good | Good |
| | 5 | Cu | Zn | 0.05 | Present | 0 | Good | Good | Good |
| | 6 | Cu | Zn | 0.1 | Present | 0 | Good | Good | Good |
| | 7 | Cu | Zn | 0.6 | Present | 0 | Good | Good | Good |
| | 8 | Cu(Ti) | Zn | 0.01 | Present | 0 | Good | Good | Good |
| Comparative example | 1 | Cu | Zn | 1 | Absent | 10 | Insufficient | Good | Poor |
| | 2 | Cu | Zn | 0.02 | Absent | 6 | Good | Good | Poor |
| | 3 | Cu | Zn | 0.02 | Absent | 4 | Good | Good | Poor |
| Conventional example | 1 | Cu | — | — | Absent | 18 | Good | Good | Poor |
| | 2 | Cu | Sn | 2 | Absent | 2 | Poor | Good | Poor |
| | 3 | Cu | Ag | 2 | Absent | 0 | Good | Poor | Poor |

The conductors in Examples 1 to 8, and Comparative examples 1 to 3 in Table 1 were produced roughly by electrolytic plating forming a various thickness Zn coating layer around a core material made of copper as a base material.

In other words, the high-speed transmission cable conductors in Examples 1 to 8 were produced by forming a coating layer of varying thickness Zn plating around a wire formed of tough pitch copper, and then annealing it in the atmosphere.

Meanwhile, in order to rate the influence of the thickness of the Zn layer on the properties of the copper based material, the high-speed transmission cable conductor in Comparative example 1 was produced by forming the Zn layer with varied thickness, and then heat treating it as in Example 1. In order to rate the influence of heat treatment conditions on the properties of the copper based material, the copper based materials in Comparative examples 2 and 3 were produced with no heat treatment (Comparative example 2), and by changing heat treatment conditions (Comparative example 3), respectively.

Further, as Conventional examples, a tough pitch copper (Conventional example 1), a tough pitch copper plated with Sn around its surface (Conventional example 2), and a tough pitch copper plated with Ag around its surface (Conventional example 3) were prepared.

Next, the details of each of the Examples, the Comparative examples and the Conventional examples will be explained.

Example 1

A 0.0042 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 50 degrees Celsius and for 10 minutes, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.003 μm thick.

Example 2

A 0.010 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 50 degrees Celsius and for 1 hour, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.006 μm thick.

Example 3

A 0.016 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 100 degrees Celsius and for 5 minutes, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.01 μm thick.

Example 4

A 0.036 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 100 degrees Celsius and for 5 minutes, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.02 μm thick.

Example 5

A 0.08 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 120 degrees Celsius and for 10 minutes, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.05 μm thick.

Example 6

A 0.16 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 150 degrees Celsius and for 30 seconds, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.1 μm thick.

Example 7

A 1 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 150 degrees Celsius and for 30 seconds, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.6 μm thick.

Example 8

A copper wire with a diameter of 1 mm consisting of a dilute copper alloy having an oxygen concentration of 7 to 8 ppm by mass, a sulfur concentration of 5 ppm by mass, and a titanium concentration of 13 ppm by mass was fabricated. This copper wire was formed with a 0.016 μm thick Zn layer therearound by electrolytic plating. Thereafter, the wire was drawn to 0.5 mm diameter, followed by electrical annealing to soften the copper core material. This was followed by heat treatment in the atmosphere at a temperature of 150 degrees Celsius and for 30 seconds, resulting in the high-speed transmission cable conductor 1. By performing the Auger analysis in a depth direction from a surface of the resulting high-speed transmission cable conductor 1, it was confirmed that the surface treated layer consisting of zinc (Zn), oxygen (O) and copper (Cu) was formed 0.01 μm thick.

Comparative Example 1

A 1.9 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 100 degrees Celsius and for 5 minutes, resulting in a high-speed transmission cable conductor. By performing the Auger analysis in a depth direction from a surface of the resulting high-speed transmission cable conductor, it was confirmed that the surface treated layer consisting of zinc (Zn), oxygen (O) and copper (Cu) was formed 1 μm thick.

Comparative Example 2

A 0.04 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 100 degrees Celsius and for 5 minutes, resulting in a high-speed transmission cable conductor. By performing the Auger analysis in a depth direction from a surface of the resulting high-speed transmission cable conductor, it was confirmed that the surface treated layer consisting of zinc (Zn), oxygen (O) and copper (Cu) was formed 0.02 μm thick.

Comparative Example 3

A 0.02 μm thick Zn layer was formed by electrolytic plating around a tough pitch copper wire with a diameter of 1 mm as the core material 2. Thereafter, the wire was drawn to 0.5 mm diameter, followed by electrical annealing to soften the copper core material. This was followed by heat treatment in the atmosphere at a temperature of 400 degrees Celsius and for 30 seconds, resulting in a high-speed transmission cable conductor. By performing the Auger analysis in a depth direction from a surface of the resulting high-speed transmission cable conductor, it was confirmed that the surface treated layer consisting of zinc (Zn), oxygen (O) and copper (Cu) was formed 0.02 μm thick.

Conventional Example 1

A tough pitch copper wire with a diameter of 1 mm was drawn to 0.5 mm diameter, followed by electrical annealing to soften the copper core material, resulting in a high-speed transmission cable conductor.

Conventional Example 2

A tough pitch copper wire with a diameter of 1 mm was drawn to 0.5 mm diameter, followed by electrical annealing to soften the copper core material. This was followed by molten Sn plating to form a Sn layer around the conductor surface, resulting in a high-speed transmission cable conductor.

Conventional Example 3

A tough pitch copper wire with a diameter of 1 mm as the core material 2 was formed with a 4 μm thick silver (Ag) layer therearound by electrolytic plating. Thereafter, the wire was drawn to 0.5 mm diameter, followed by electrical annealing to soften the copper core material, resulting in a high-speed transmission cable conductor. By performing the Auger analysis in a depth direction from a surface of the resulting high-speed transmission cable conductor, it was confirmed that the surface treated layer consisting of Ag was formed 2 μm thick.

(Rating Method)

The surface treated layers formed in each high-speed transmission cable conductor in Table 1 were determined from the results of the Auger spectroscopy.

The presence of the amorphous layer in Table 1 was confirmed by RHEED (Reflection High Energy Electron Diffraction) analysis. When a halo pattern indicating the presence of the amorphous layer was confirmed, the amorphous layer was determined as "Present," or when electron beam diffraction spots indicating a crystalline structure are confirmed, the amorphous layer was determined as "Absent."

The connection failure rate (percent), high frequency transmission properties, cost, and overall ratings of each high-speed transmission cable conductor produced in Table 1 were performed as follows.

After a holding test in atmosphere at 100 degree Celsius and for 100 h, the connection failure rate was rated by a solder dipping test using 50 samples. The connection failure rate was rated as a number of the failure samples (NNG), whose solder wetting area ratio ((solder wetting area/solder dipping area)×100) falls below 90%. In other words, the connection failure rate was defined as (NNG/50)×100.

Further, by using samples after a holding test in atmosphere at 150 degrees Celsius and for 340 h, a Meniscograph solder wetting test was conducted. A solder checker (RHESCA CO., LTD.) was used for the solder wetting test, and the time until solder wetting completion was used as a rating index.

For rating the high-frequency transmission properties, the resistance attenuations due to changing the kinds of the conductors but using the same cable configuration conditions such as conductor diameter, covering insulation, etc. were rated for each frequency from 0 to 15 GHz.

(Rated Results)

Figure 4:
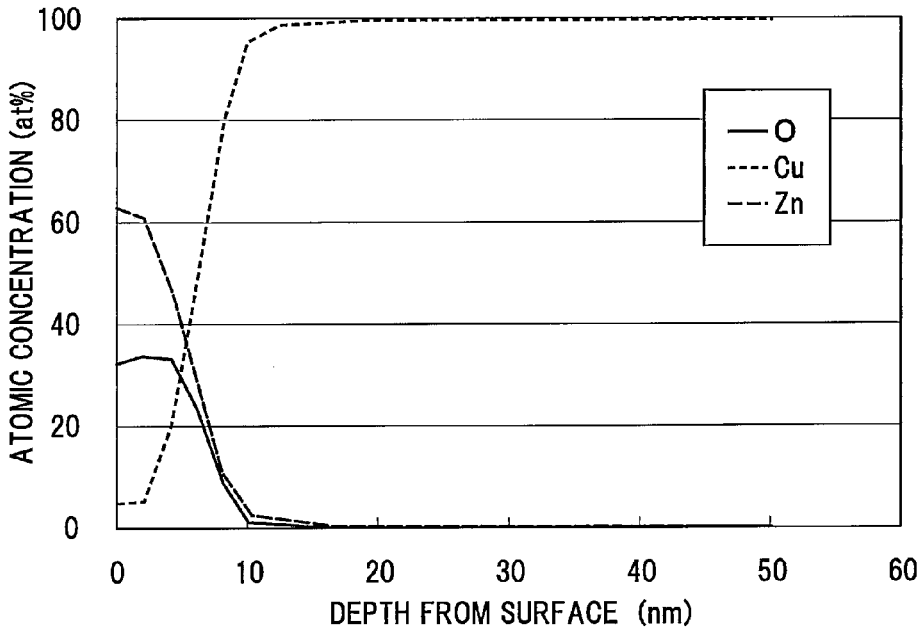
FIG. 4 is a graph showing results of Auger elemental analysis in a depth direction while repeating sputtering from a surface layer, of a specimen for 3600 hours in an isothermal (100 degrees Celsius) holding test for a high-speed transmission cable conductor in Example 3 according to the invention.

FIG. 4 is a graph showing results of Auger elemental analysis in a depth direction while repeating sputtering from a surface layer, of a specimen for 3600 hours in the isothermal (100 degrees Celsius) holding test for the high-speed transmission cable conductor in Example 3. The horizontal axis represents the depth (nm) from the surface, and the vertical axis represents the atomic concentration (at %), and the solid line indicates the atomic concentration (at %) as the content ratio of oxygen (O), the long broken line indicates the atomic concentration of zinc (Zn), and the short broken line indicates the atomic concentration of copper (Cu). The oxygen penetration depth was about 10 nm from the surface, and particularly when the average elemental content ratio in a 0 to 3 nm deep surface layer region is defined as (maximum atomic concentration of each element at 0 to 3 nm depth−minimum atomic concentration thereof)/2, zinc (Zn) was 60 at %, oxygen (O) was 33 at %, and copper (Cu) was 7 at %, in Example 3.

Also, it was found that when the above defined average elemental content ratio included those of the other Examples, zinc (Zn) was in a range of 35 to 68 at %, oxygen (O) was in a range of 30 to 60 at %, and copper (Cu) was in a range of 0 to 15 at %.

On the other hand, the high-speed transmission cable conductor in Comparative example 1 had 33 at % of zinc (Zn), 41 at % of oxygen (O), and 26 at % of copper (Cu), and the high-speed transmission cable conductor in Comparative example 2 had 5 at % of zinc (Zn), 46 at % of oxygen (O), and 49 at % of copper (Cu).

Figure 5:
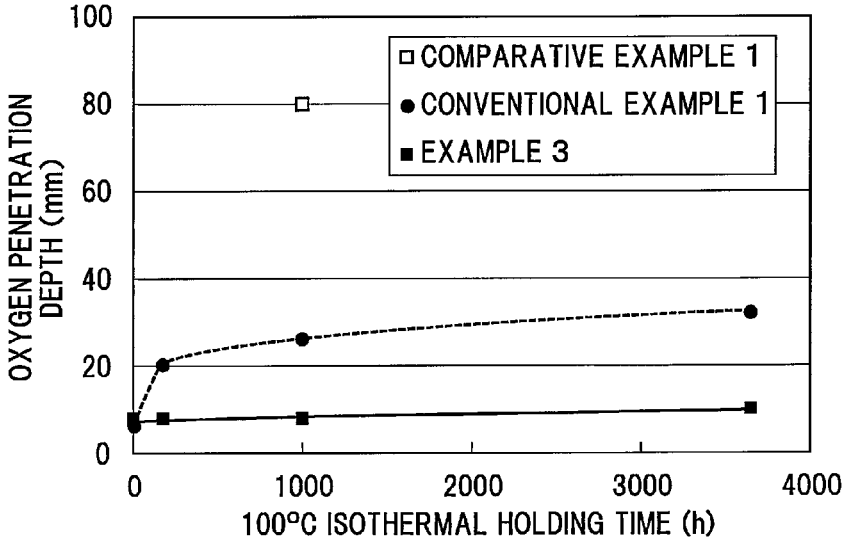
FIG. 5 is a graph showing respective time variations of oxygen penetration depths (oxide film thicknesses) from respective surface layers, in the isothermal (100 degrees Celsius) holding test for respective high-speed transmission cable conductors in Example 3 according to the invention, Comparative example 1 and Conventional example 1.

FIG. 5 is a graph showing respective time variations of oxygen penetration depths (oxide film thicknesses) from respective surface layers, in the isothermal (100 degrees Celsius) holding test for the respective high-speed transmission cable conductors in Example 3, Comparative example 1 and Conventional example 1. The oxygen penetration depth was determined by Auger analysis in a depth direction while repeating sputtering from a surface of samples held for each time. In FIG. 5, the horizontal axis represents the 100 degree Celsius isothermal holding time (h), and the vertical axis represents the oxygen penetration depth (nm), and the solid line indicates the oxygen penetration depth in Example 3, and the broken line indicates the oxygen penetration depth in Conventional example 1. In addition, the oxygen penetration depth in Comparative example 1 is indicated by a point.

In Example 3, as shown in FIG. 5, after holding for 3600 hours, the oxygen concentration near the surface increased, but the penetration depth was substantially unchanged from the test and was about not more than 0.01 μm, and the high-speed transmission cable conductor 1 in Example 3 exhibited high oxidation resistance.

Meanwhile, as shown in FIG. 5, the thickness of the layer including oxygen in Conventional example 1 before the isothermal holding test was about 0.006 μm from the surface, and was the depth of the same order as in Example 3 before the isothermal holding test, but in Conventional example 1 after the 3600 hour holding test, the oxygen concentration near the surface significantly increased as compared to before the isothermal holding test, and the oxygen penetration depth in Conventional example 1 was about 0.036 μm which was 5 times or more the oxygen penetration depth before the test. Further, Conventional example 1 after the test was discolored to red and brown in appearance, and it was clearly possible to determine that a layer including oxygen was formed thick. Further, in Comparative example 1 formed with a 1 μm Zn layer around a tough pitch copper, the oxygen penetration depth reached about 0.080 μm already after the 1000 hour holding test.

Figure 6:
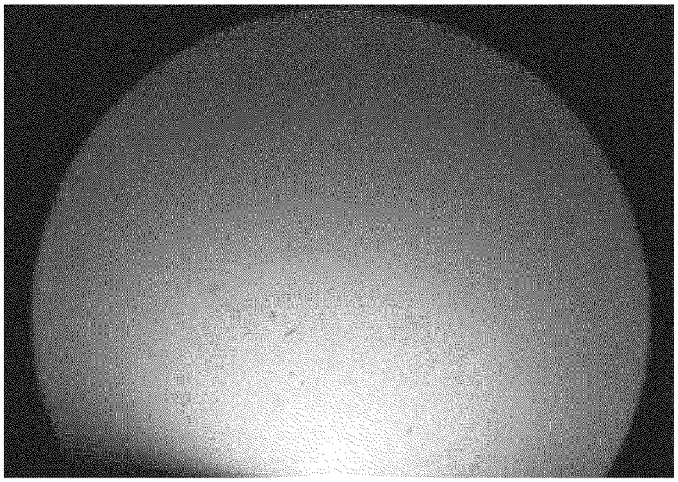
FIG. 6 is an electron beam diffraction pattern showing an RHEED analysis result of the high-speed transmission cable conductor in Example 3 according to the invention.

FIG. 6 shows the results of the RHEED analysis of the surface in Example 3 which was excellent in corrosion resistance. The electron beam diffraction image exhibited a halo pattern, and it was found that the amorphous layer was formed around the surface. Meanwhile, Conventional example 1 which was poor in corrosion resistance was confirmed as having crystallinity consisting of copper and oxygen.

(Connection Reliability)

With respect to connection reliability, for Examples 1 to 8, and Conventional example 3, the failure rate showed as excellent properties as zero. Meanwhile, even in Comparative examples 1 to 3 also having a Zn based surface treated layer, it was confirmed that no good performance resulted. When the thickness of the Zn based surface treated layer was thick as in Comparative example 1, when after plating no heat treatment was performed as in Comparative example 2, or when after plating excessive heat treatment was performed as in Comparative example 3, the rated results of any of those with no amorphous formed around the surface layer were "Poor." Conventional example 1 caused many connection failures which seemed to be due to the oxidation of copper. Conventional example 2 also caused a slight failure.

Figure 7:
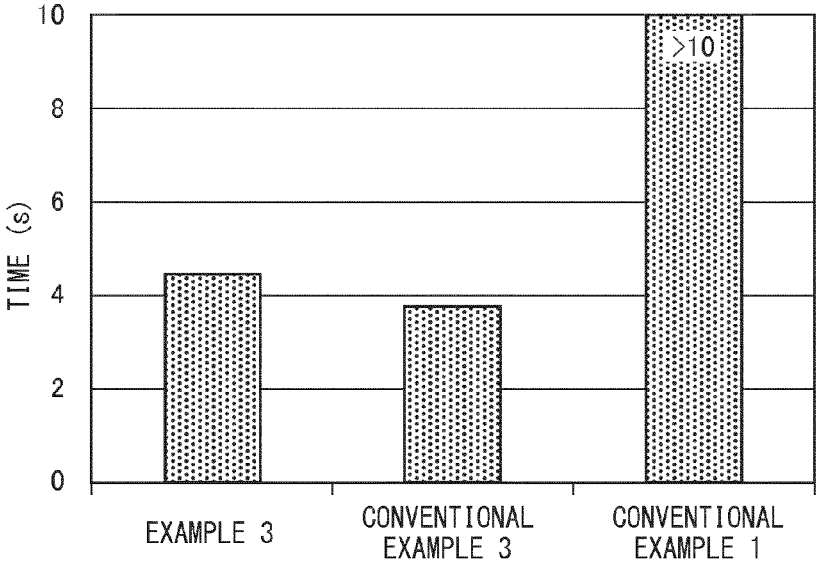
FIG. 7 is a graph showing respective results of a solder wetting test in Example 3 according to the invention, and Conventional examples 1 and 3.

FIG. 7 shows rated result examples of solder wettability with a Meniscograph method. Because the vertical axis is the time until solder wetting completion, it is possible to determine that the smaller the vertical axis value, the more excellent the solder wettability. It was shown that Example 3 and Conventional example 3 completed solder wetting in a short period of time, and were excellent in wettability, whereas Comparative example 1 did not complete solder wetting even after 10 seconds which is the maximum value of the test time of this time, and was poor in wettability.

(High-Frequency Transmission Properties)

Figure 8:
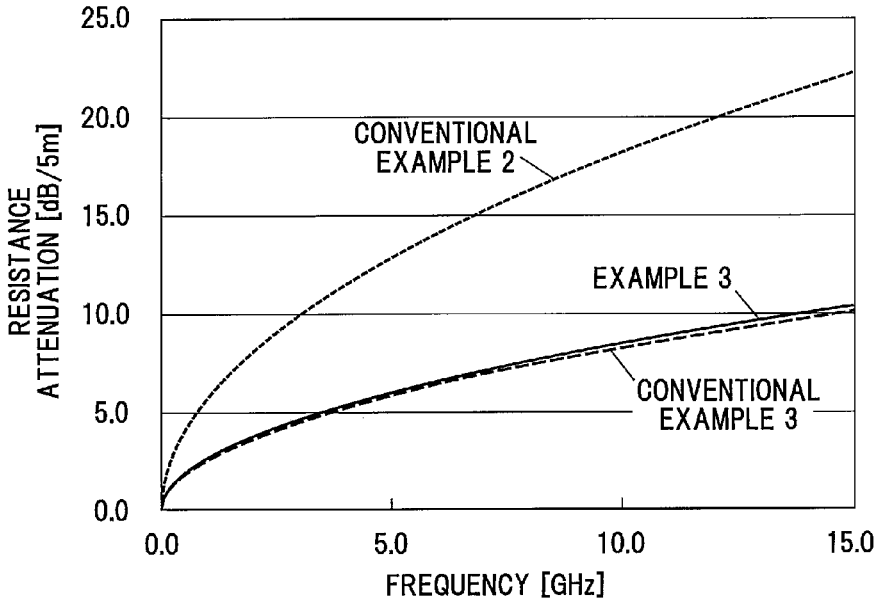
FIG. 8 is a graph illustrating respective high-frequency transmission properties (resistance attenuations) in Example 3 according to the invention, and Conventional examples 1 and 3.

FIG. 8 shows rated result examples of the high-frequency transmission properties. It was found that the resistance attenuation in Example 3 in 0 to 15 GHz band was as small as that of Conventional example 3 using Ag which was the most excellent in electrical conductivity of the material itself among numerous metal elements, and that Example 3 had the excellent high-frequency transmission properties. Meanwhile, it was shown that Conventional example 2 had the remarkably large resistance attenuation in all frequency bands, and the significantly poor high-frequency transmission properties, as compared with Conventional example 3 and Example 3. In particular, because the higher frequency, the more its difference spread, the use of the conductor in Conventional example 2 in high frequency applications can be determined as unsuitable.

(Cost)

For cost (economic efficiency), Examples 1 to 8 according to the invention, and Comparative examples 1 to 3 were excellent in productivity and economic efficiency because of requiring no noble metal coating which was significantly high in material cost though excellent in corrosion resistance of the material itself, but using inexpensive Zn, and moreover being sufficiently thin in thickness thereof. Due to the unit cost of the material being hundreds of times that of Zn, Ag in Conventional example 3 is inevitably expensive.

From these results, in overall rating, the present Examples 1 to 8 can be proposed as the high-speed transmission cable conductor which is low in cost yet excellent in connection reliability and high frequency transmission properties.

Incidentally, the invention is not limited to the above described embodiments, various modifications may be made without altering the spirit of the invention.

Further, some of the constituent elements of the above described embodiments may be omitted without altering the spirit of the invention.

Further, in the production method in the above embodiments, step additions, deletions, replacements, substitutions, and the like may be made without altering the spirit of the invention Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A high-speed transmission coaxial cable, comprising:

an inner conductor;

an insulator provided around an outer periphery of the inner conductor;

an outer conductor provided around an outer periphery of the insulator; and a sheath provided around an outer periphery of the outer conductor, wherein the inner conductor comprises:

a core material comprising mainly copper, and a surface treated layer formed around a surface of the core material, the surface treated layer comprising an amorphous layer consisting essentially of a metal element, oxygen and copper, the metal element having a higher affinity for oxygen than the copper included in the amorphous layer, wherein the copper is diffused from the core material, and the metal element and the oxygen of the amorphous layer are predominantly bonded together.

2. The high-speed transmission coaxial cable according to claim 1, wherein the surface treated layer further comprises a diffusion layer under the amorphous layer, the diffusion layer including copper and a metal element having a higher affinity for oxygen than the copper, or copper, a metal element having a higher affinity for oxygen than the copper, and oxygen.

3. The high-speed transmission coaxial cable according to claim 2, wherein a total thickness of the amorphous layer and the diffusion layer comprises not less than 6 nm and not more than 0.6 μm.

4. The high-speed transmission coaxial cable according to claim 1, wherein the metal element having a higher affinity for oxygen than the copper in the amorphous layer is zinc.

5. The high-speed transmission coaxial cable according to claim 1, wherein the surface treated layer comprises a thickness of not less than 3 nm and not more than 0.6 μm.

* * * * *